US006645009B1

(12) United States Patent
Billman et al.

(10) Patent No.: US 6,645,009 B1
(45) Date of Patent: Nov. 11, 2003

(54) HIGH DENSITY ELECTRICAL CONNECTOR WITH LEAD-IN DEVICE

(75) Inventors: Timothy B. Billman, Dover, PA (US); Iosif R. Korsunsky, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/162,724

(22) Filed: Jun. 4, 2002

(51) Int. Cl.[7] ..... H01R 13/648
(52) U.S. Cl. ..... 439/608; 439/108
(58) Field of Search ..... 439/608, 108, 439/101, 79, 76.1, 701

(56) References Cited

U.S. PATENT DOCUMENTS 5,980,321 A * 11/1999 Cohen et al. ..... 439/608
6,083,047 A * 7/2000 Paagman ..... 439/608
6,152,747 A * 11/2000 McNamara ..... 439/108
6,168,469 B1 * 1/2001 Lu ..... 439/608
6,171,115 B1 1/2001 Mickievicz et al.
6,174,202 B1 * 1/2001 Mitra ..... 439/608
6,267,604 B1 7/2001 Mickievicz et al.
6,293,827 B1 * 9/2001 Stokoe ..... 439/608
6,299,484 B2 * 10/2001 Van Woensel ..... 439/608
6,375,508 B1 * 4/2002 Pickles et al. ..... 439/608
6,390,857 B1 * 5/2002 Pickles et al. ..... 439/701

* cited by examiner

*Primary Examiner*—Gary Paumen
(74) *Attorney, Agent, or Firm*—Wei Te Chung

(57) ABSTRACT

An electrical connector (1) comprises an insulative housing (10) defining a plurality of channels (14), a plurality of circuit boards (30) partially received in the channels, and a spacer (20) assembled with the circuit boards. The spacer includes a plurality of wafers (21) and defines a plurality of tunnels (200) between every two adjacent wafers for partially receiving corresponding circuit boards. Each wafer has a body portion (22), a plurality of terminals (23) for conductively contacting with the circuit board, and a grounding bus (24) covering on the body portion. Each grounding bus forms lead-in portions (245, 248) at opposite sides of an upper end thereof for facilitating insertion of the circuit board and a neighboring circuit board.

1 Claim, 10 Drawing Sheets

HIGH DENSITY ELECTRICAL CONNECTOR WITH LEAD-IN DEVICE

CROSS-REFERENCE TO RELATED APPLICATION

This application is a co-pending application of U.S. Pat. application with Ser. No. 10,161,471 filed on May 30, 2002, entitled "HIGH DENSITY ELECTRICAL CONNECTOR WITH IMPROVED GROUNDING BUS", invented by the same inventors, assigned to the same assignee and filed on the same date as the present application. The disclosures of the co-pending application are wholly incorporated herewith by reference.

BACKGROUND OF THE INVENTION

1. Field of the Invention

The present invention relates to an electrical connector, and particularly to a high density electrical connector having a plurality of circuit boards for high speed signal transmission.

2. Description of Related Art

With the development of communication and computer technology, high-density electrical connectors with conductive elements in a matrix arrangement are desired to construct a large number of signal transmitting paths between two electronic devices. The high-density electrical connectors are widely used in internal connecting systems of severs, routers and the other like devices requiring high-speed data processing and communication. Such high-density electrical connectors are disclosed in U.S. Pat. Nos. 6,152,747, 6,267,604, 6,171,115, 5,980,321, and 6,299,484. These high-density connectors generally comprise two mating connector halves, i.e., a plug connector half connecting with a backplane and a receptacle connector half connecting with a daughter card and for mating with the plug connector half, thereby establishing an electrical circuitry between the daughter card and the backplane.

Especially, connectors disclosed in U.S. Pat. Nos. 6,267,604 and 6,171,115, each comprise a front housing portion having a front wall with a plurality of parallel apertures extending therethrough, an organizer attached to the front housing portion and a plurality of printed circuit boards retained between the front housing portion and the organizer. Both the front housing portion and the organizer are made of plastic material or the other like materials. The organizer has a plurality of slots that are spaced-apart corresponding to the apertures, and a plurality of openings communicating with the slots in a bottom wall thereof. The circuit boards each form signal and grounding traces on opposite sides thereof and have a mating edge which is inserted through the aperture of the front housing portion for mating with a complementary connector. Mounting edges of the circuit boards are inserted through the slots of the organizer and have soldering tails for electrically connecting with a circuit substrate.

However, since the front housing portion and the organizer are made of plastic material and have no lead-in mechanism provided thereon, insertion of the circuit boards therein needs a large push force, and cannot be smoothly performed. This results in that during insertion, the signal and grounding traces of the circuit boards may be easily scrapped or damaged by the relatively rigid front housing portion and the organizer, thereby adversely affecting electrical connection of the circuit boards with the complementary connector.

Hence, an improved high-density electrical connector is required to overcome the disadvantages of the prior art device.

SUMMARY OF THE INVENTION

Accordingly, a first object of the present invention is to provide a high density electrical connector having a plurality of circuit boards to transmit high speed signals between two electronic devices.

A second object of the present invention is to provide a high density electrical connector having a plurality of individual daughter circuit boards which can be smoothly inserted into a housing of the connector without being scrapped or damaged.

To fulfill the above objects, an electrical connector, to be mounted on a mother board, in accordance with the present invention comprises an insulative housing defining a plurality of channels, a plurality of circuit boards partially received in the channels, and a spacer assembled with the circuit boards. The spacer includes a plurality of wafers defining a plurality of tunnels between every two adjacent wafers for partially receiving corresponding circuit boards. Each wafer has a body portion, a plurality of signal terminals molded with the body portion and conductively contacting with corresponding signal traces formed on a corresponding circuit board, and a grounding bus covering the body portion. The grounding bus forms a plurality of grounding tabs conductively contacting with grounding traces formed on the circuit board. Each grounding bus forms smooth slope portions at opposite sides of an upper end thereof for facilitating insertion of the corresponding circuit board and a neighboring circuit board into corresponding tunnels, respectively.

Other objects, advantages and novel features of the invention will become more apparent from the following detailed description when taken in conjunction with the accompanying drawings.

DETAILED DESCRIPTION OF THE INVENTION

Figure 1:
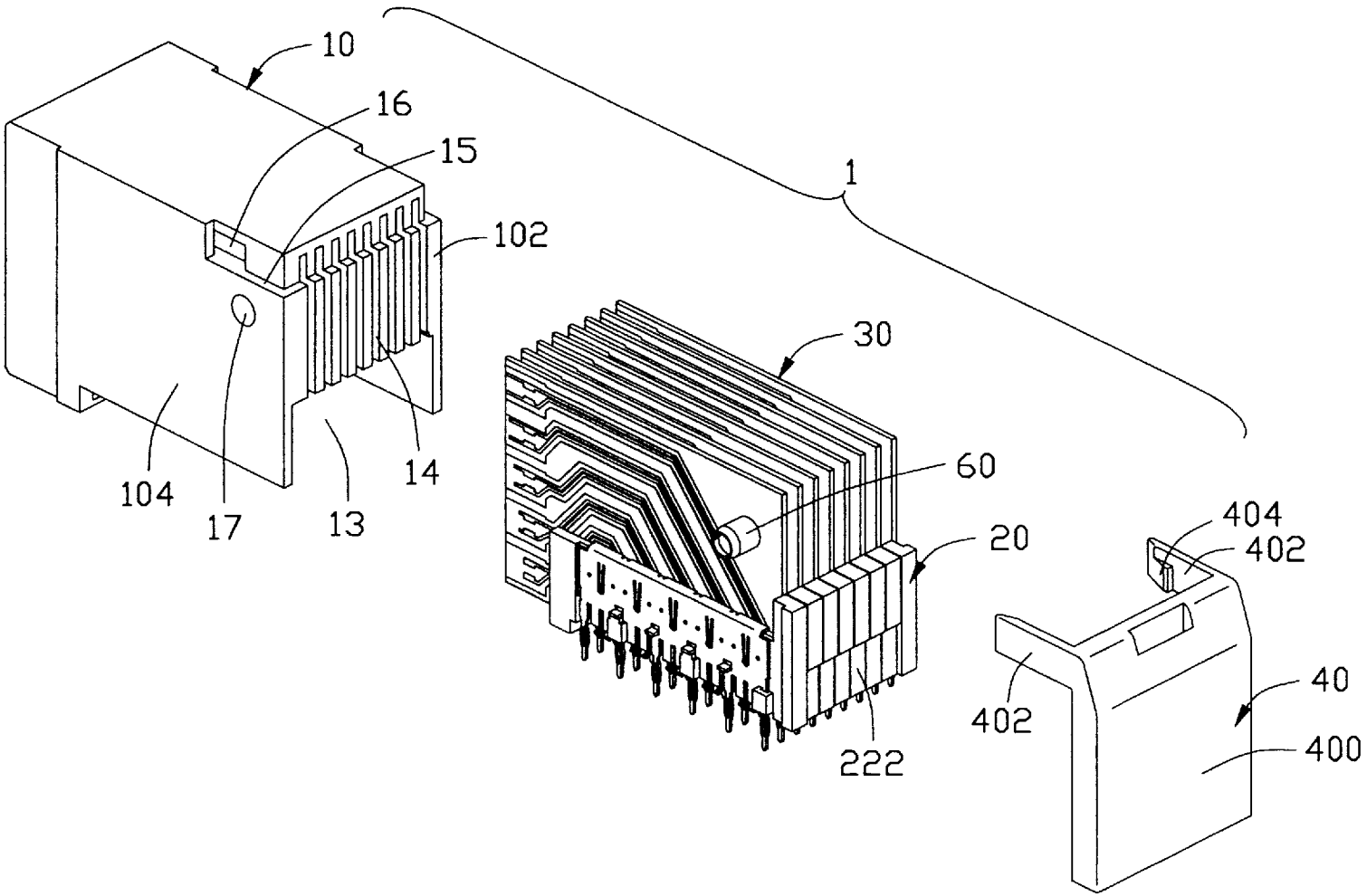
FIG. 1 is an exploded perspective view of an electrical connector in accordance with the present invention.
Figure 2:
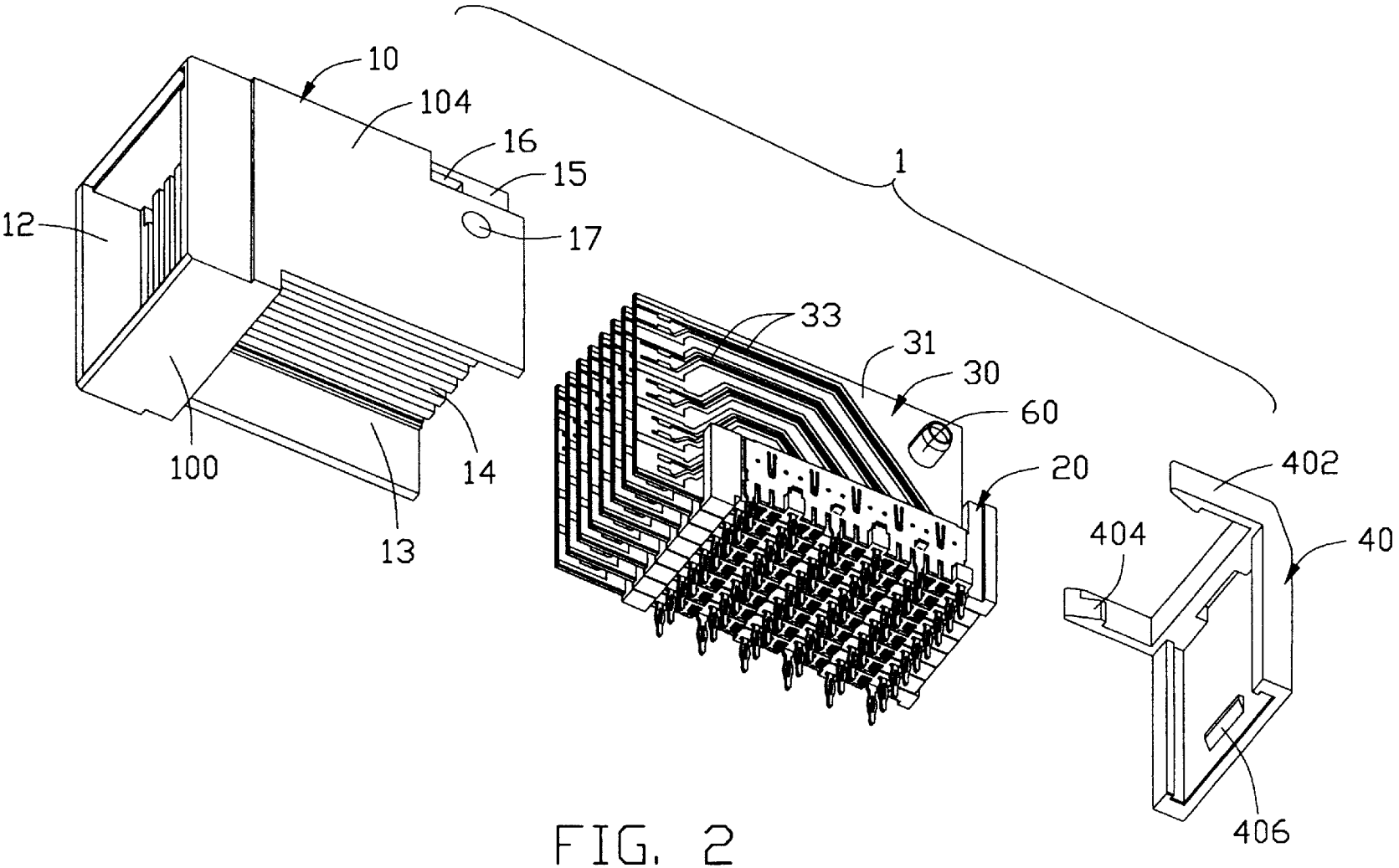
FIG. 2 is another exploded perspective view of FIG. 1.

Referring to FIGS. 1-2, an electrical connector 1 in accordance with a preferred embodiment of the present invention comprises a dielectric housing 10, a spacer 20, a plurality of circuit boards 30 retained in the spacer 20, and a fastening device 40 securing the spacer 20 combined with the circuit boards 30 to the housing 10. Each circuit board 30 includes a dielectric substrate 31 made of conventional circuit board substrate material, such as FR4, and a plurality of conductive signal and grounding traces 33 formed on opposite side surfaces 35 thereof.

The dielectric housing 10 is generally in a rectangular shape and defines a front mating port 12 for partially receiving a complementary connector (not shown). The housing 10 defines an opening 13 extending through a bottom face 100 and a rear face 102 thereof, and a plurality of parallel channels 14 in communication with the opening 13. The channels 14 extend in a longitudinal direction of the housing 10 between the front mating port 12 and the rear face 102. The housing 10 further defines a pair of cutouts 15 adjacent to the rear face 102 in opposite side faces 104 thereof, and a pair of cavities 16 recessed from the cutouts 15. Additionally, a through hole 17 extends in a transverse direction through the opposite side faces 104 of the housing 10.

Figure 3:
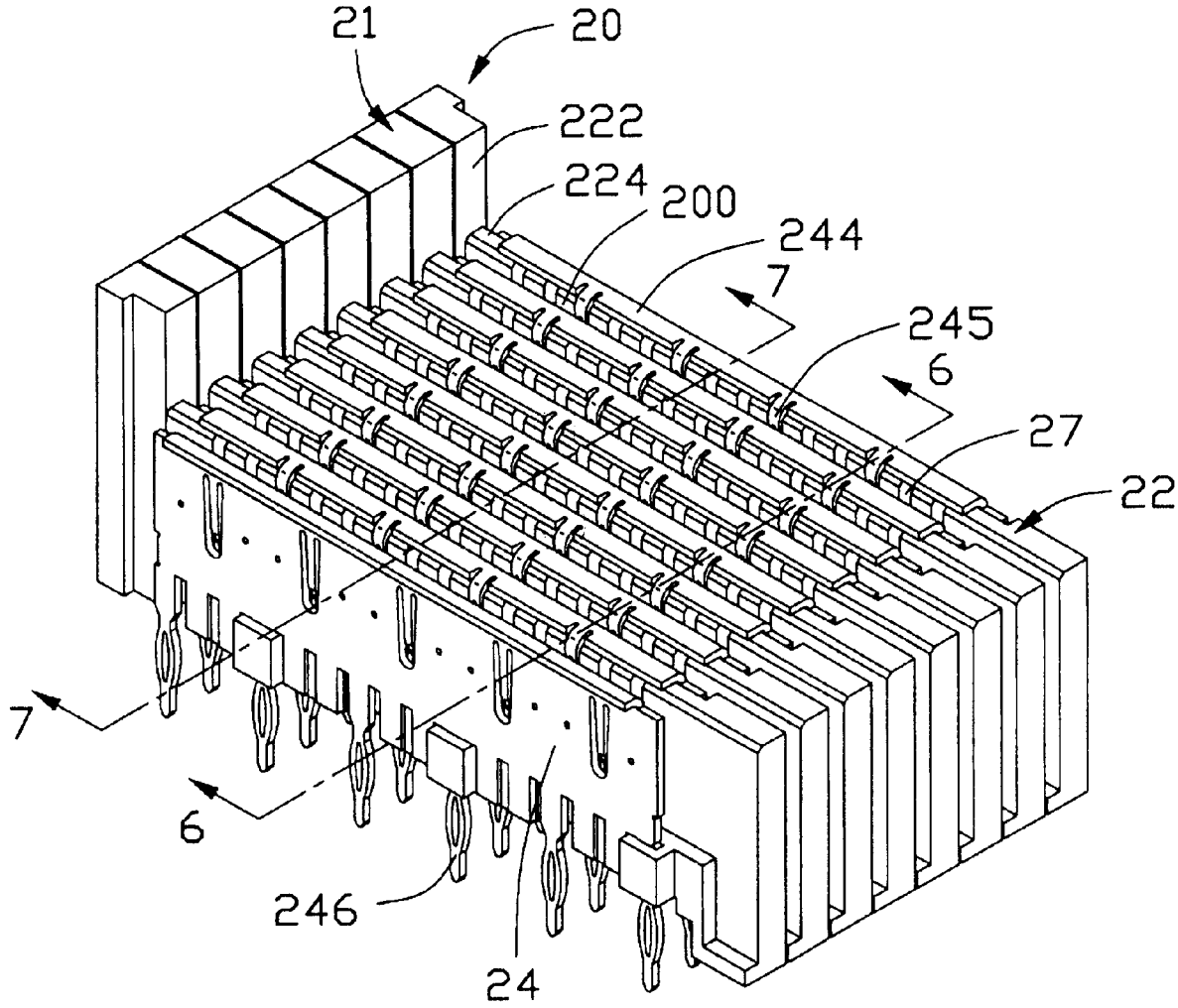
FIG. 3 is an enlarged perspective view of a spacer of the electrical connector of FIG. 1.

Referring to FIG. 3, the spacer 20 alone with the plurality of daughter bards 30 removed therefrom is shown in its enlarged respective view. The spacer 20 consists of a plurality of wafers 21 side by side arranged and defines a plurality of tunnels 200 between every two adjacent wafers 21. Each tunnel 200 has a predetermined width for receiving a corresponding circuit board 30. It is noted that the cross reference which detailed described the construction of each wafer 21 is incorporated herewith by reference, and thus, only a summary description of the wafer 21 is described below.

Figure 4:
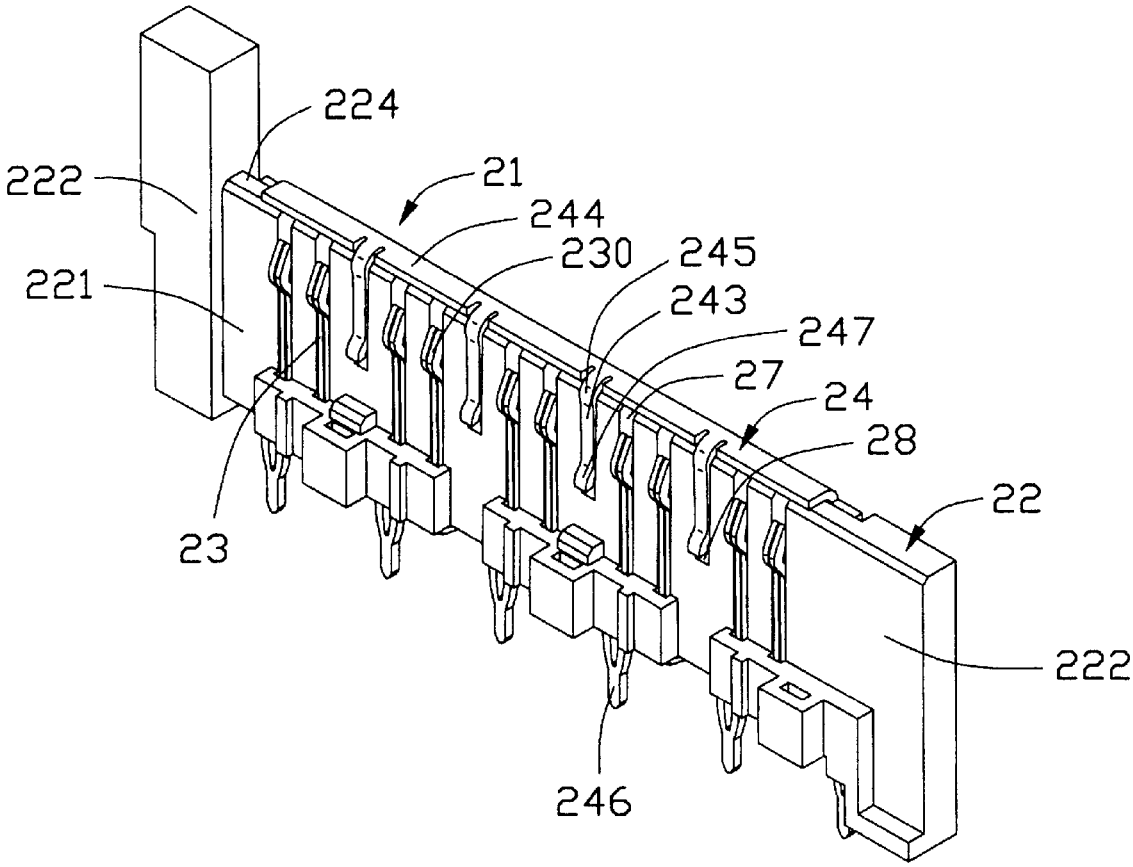
FIG. 4 is a perspective view of a wafer of the spacer of FIG. 3.
Figure 5:
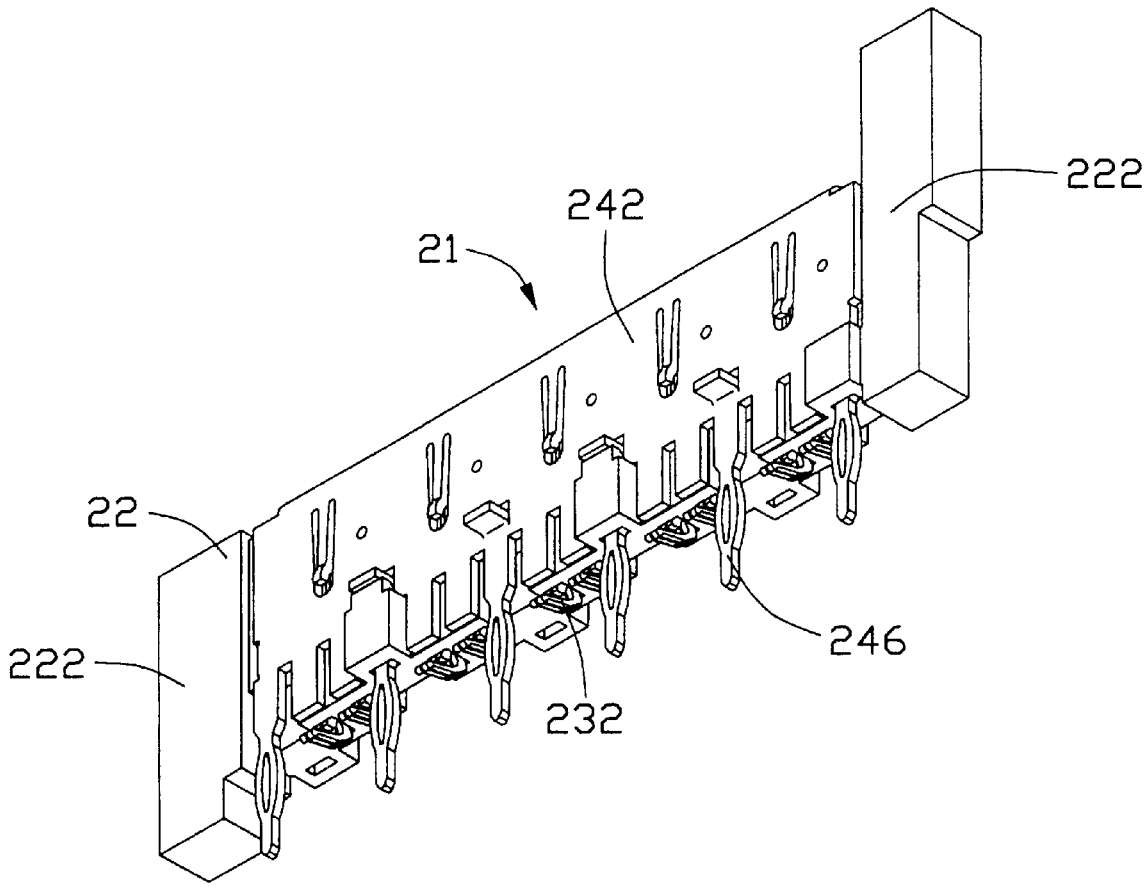
FIG. 5 is another perspective view of the wafer of FIG. 4.

Referring to FIGS. 4 and 5, each wafer 21 includes a body portion 22, a plurality of signal terminals 23 insert molded with the body portion 22, and a grounding bus 24 covered on the body portion 22. The body portion 22, made of non-conductive material, such as plastic or the other like material, defines a plurality of passageways 27 and a plurality of slots 28 among the passageways 27 in one side surface 221 thereof. In addition, a pair of end portions 222 extend from opposite ends of the body portion 220 in opposite directions.

Figure 9:
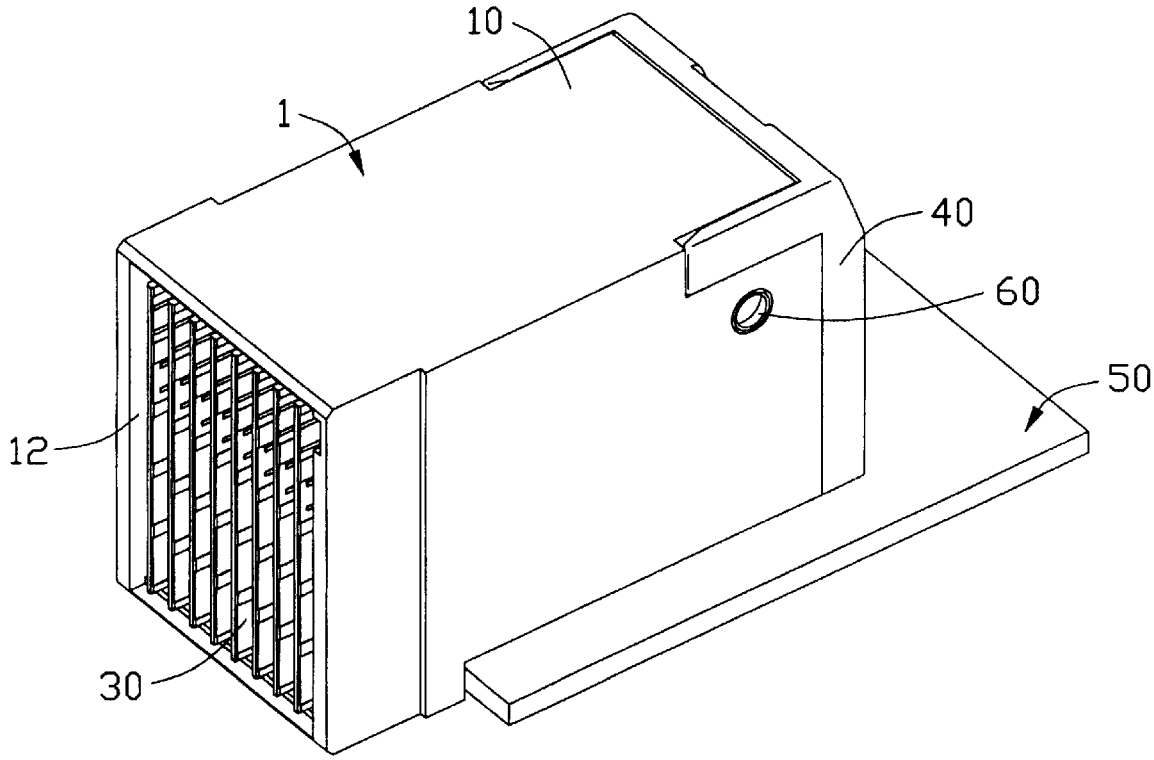
FIG. 9 is an assembled perspective view of the electrical connector of FIG. 1.
Figure 10:
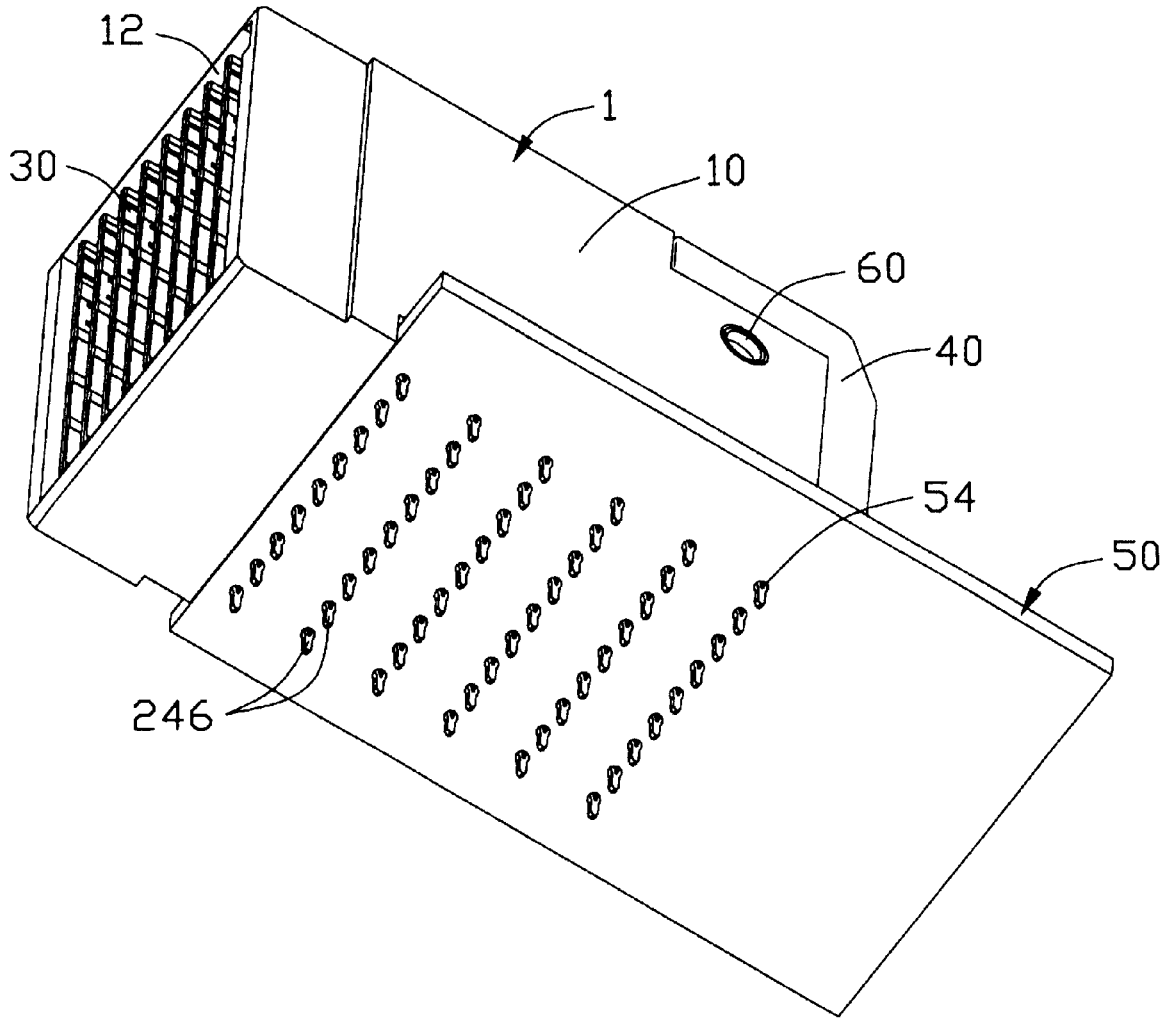
FIG. 10 is an assembled perspective view of the electrical connector of FIG. 2.

Each signal terminal 23 is insert molded in a corresponding passageway 27 of the body portion 22. The signal terminal 23 has a contact portion 230 projecting out of the side surface 221 for conductively contacting with a corresponding signal trace 33 of the circuit board 30 and a solderless mounting tail 232 extending beneath the body portion 22 for conductively contacting a corresponding electronic pad 52 on the mother board 50 (FIGS. 9 and 10).

Figure 6:
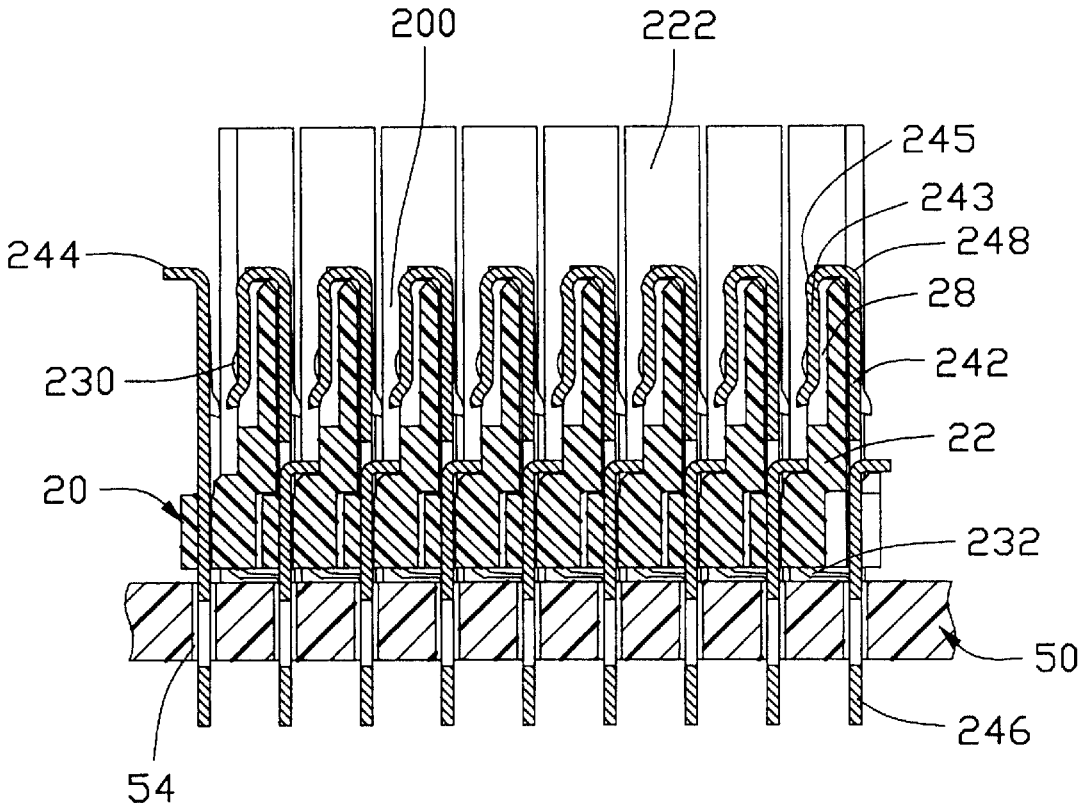
FIG. 6 is a cross-sectional view of the spacer taken along line 6—6 of FIG. 3.
Figure 7:
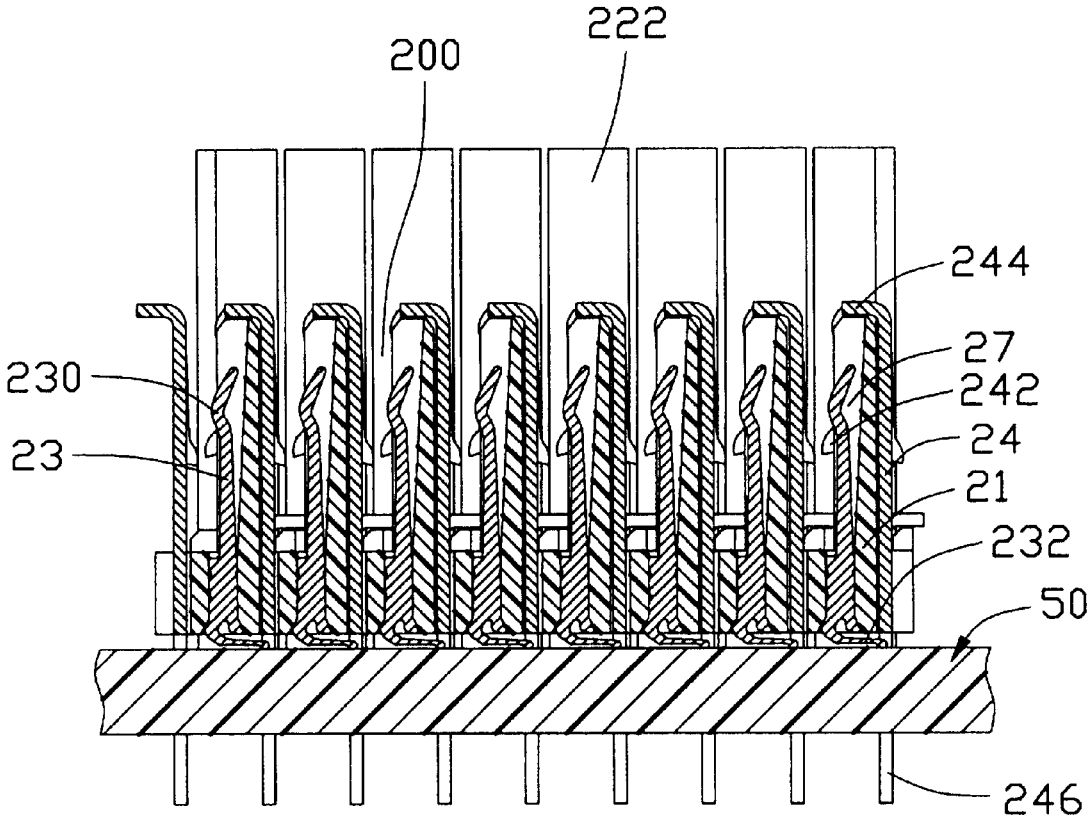
FIG. 7 is a cross-sectional view of the spacer taken along line 7—7 of FIG. 3.

The grounding bus 24 has a body plate 242 covering on the other side surface (not labeled) opposite to the one side surface 221 of the body portion 22. A flange 244. vertically extends from an upper edge of the body portion 22 and covers on a top surface 224 of the body portion 22. A plurality of grounding tabs 243 extend downward from an outer edge of the flange 244 into corresponding slots 28 of the body portion 22. Each grounding tab 243 forms at an upper end thereof a lead-in portion 245 which is in a smooth slope shape and adjacent to the flange 244. The grounding tab 243 further forms a protrusion 247 projecting out of the side surface 221 of the body portion 22 for conductively contacting a corresponding grounding trace of the circuit board 30. In addition, the grounding bus 24 defines a lead-in section 248, shaped in a chamfered portion and opposite to the lead-in portion 245, at the common boundary portion between the flange 244 and the body portion 22 thereof for facilitating an insertion of a neighboring circuit board 30. Furthermore, a plurality of press-fit tails 246 extend beneath the body portion 22 for insertion into corresponding through holes 54 of the mother board 50 (FIG. 6).

Referring back to FIGS. 1 and 2, the fastening device 40 forms a body wall 400 and a pair of latch arms 402 vertically extending from opposite sides of the body wall 400. The body wall 400 forms a bump 406 at the inside thereof for abutting against the end portions 222 of the spacer 20. Each latch arm 402 forms a latch projection 404 for latching into a corresponding cavity 16 of the housing 10.

In assembly, referring to FIGS. 1-2 and 9-10, the circuit boards 30 fastened by a hinge axel 60, are firstly inserted into corresponding tunnels 200 of the spacer 20 successfully and securely from the above of the spacer 20, as will be explained hereinafter. Then, the circuit boards 30 combined with the spacer 20 are horizontally inserted into corresponding channels 14 of the housing 10 from the back of the housing 10. The hinge axel 60 is inserted in the hole 17 of the housing 10 for holding the circuit boards 30 in position. Next, the fastening device 40 is covered on the back of the housing 10, and the latch arms 402 thereof extend along the cutouts 15 until the latch projections 404 thereof are lathed into corresponding cavities 16 of the housing 20, thereby effectively retaining the spacer 20 and the circuit boards 30 to the housing 10. Finally, electrical connector 1 is mounted onto the mother board 50. The mounting tails 232 of the terminals 23 are conductively contacted with corresponding electric pads 52 of the mother board 50. The grounding tails 246 of the grounding buses 24 are press-fitted into corresponding through holes 54 of the mother board 50. Thus, an assembled electrical connector 1 mounted on the mother board 50 is obtained, as shown in FIGS. 9 and 10.

Figure 8:
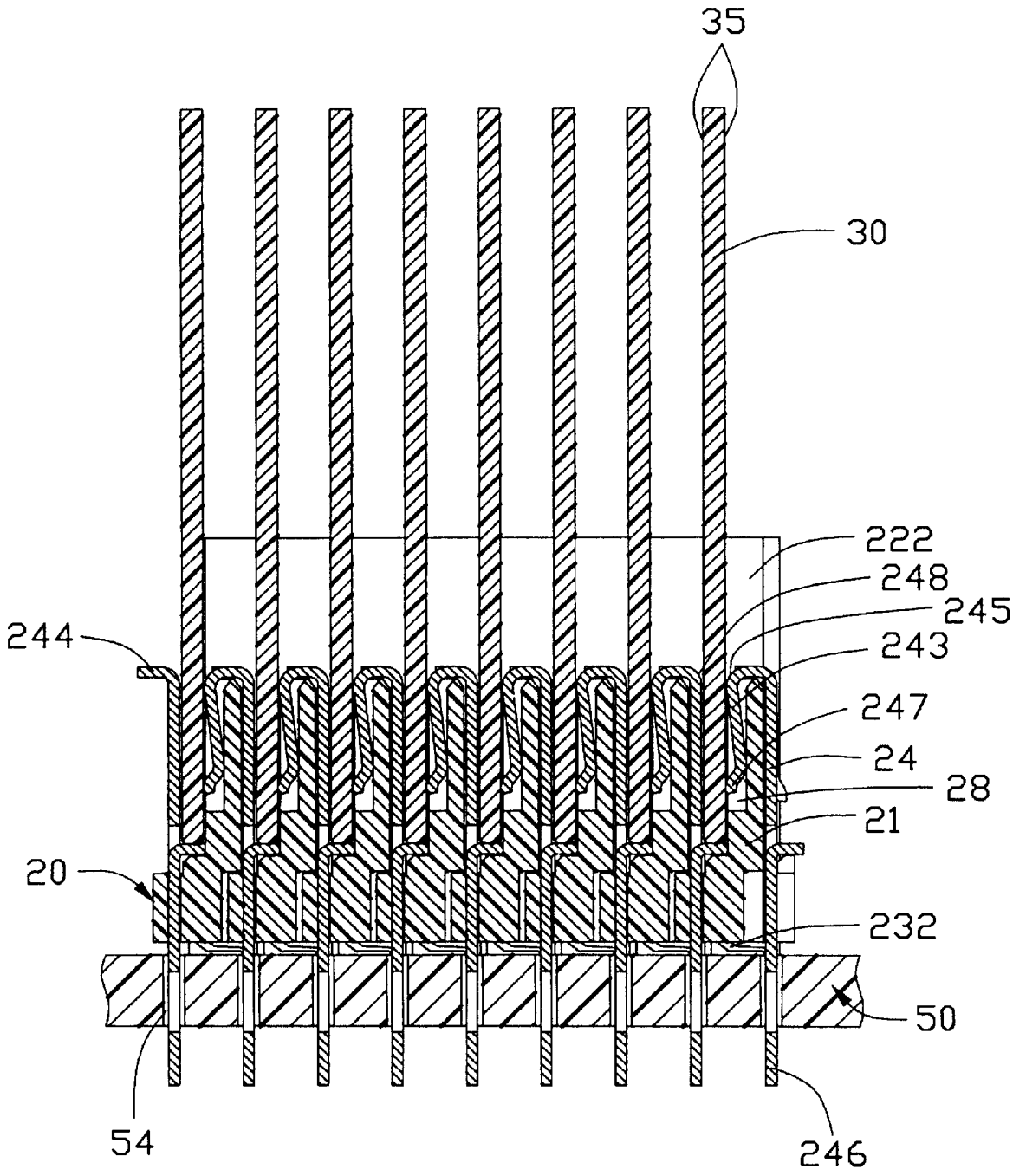
FIG. 8 is a cross-sectional view of the spacer of FIG. 6 with a plurality of circuit boards inserted therein.

As best seen in FIG. 8, the lead-in portions 245 of one grounding bus 24 and a facing lead-in section 248 of an adjacent grounding bus 24, which are associated with a common tunnel 200, cooperatively guide opposite side surfaces 35 of a corresponding circuit board 30 smoothly and reliably extending into the common tunnel 200. Thus, the circuit boards 30 are inserted into the spacer 20 without signal and grounding traces 33 on opposite side surfaces 35 thereof being scrapped or damaged, thereby the circuit boards 30 electrically connecting with corresponding signal terminals 23 and grounding tabs 243 of the grounding bus 24, effectively and reliably. Accordingly, the electrical connector 1 of the present invention is provided with a smooth and reliable way for inserting the circuit boards 30 into the spacer 20 with respect to the prior arts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted on a mother board, comprising:

an insulative housing defining a plurality of channels;

a plurality of circuit boards partially received in the channels; and a spacer including a plurality of wafers defining a plurality of tunnels between every two adjacent wafers for receiving corresponding circuit boards, each wafer having a body portion, a plurality of terminals retained in the body portion and conductively contacting with signal traces formed on a corresponding circuit board, and a grounding bus covering on the body portion and having a plurality of grounding tabs for conductively contacting with grounding traces formed on the circuit board; wherein at least one grounding tab of the wafer forms a smooth slope portion at an upper end thereof for facilitating insertion of the circuit board;

wherein the plurality of wafers are side-by-side arranged;

wherein the body portion of each wafer defines in one side surface thereof a plurality of passageways for receiving the terminals and a plurality of slots for receiving corresponding grounding tabs of the grounding bus;

wherein the grounding bus has a body plate covering another side surface of the body portion of each wafer, a flange vertically extending from an upper edge of the body plate and covering a top face of the body portion of each wafer, and a plurality of grounding tails depending from a lower edge of the body plate for insertion into corresponding through holes of the mother board;

wherein the grounding tabs extend from the flange and are received in corresponding slots of the body portion;

wherein the smooth slope portion of the grounding tab is adjacent to the flange;

wherein the grounding bus forms a chamfered portion at a common boundary portion between the flange and the body plate of the grounding bus for facilitating insertion of a corresponding circuit board;

wherein each terminal and each grounding tab respectively forms a contact point and a protrusion for conductively contacting with a corresponding signal trace and a corresponding grounding trace of the circuit board, respectively;

wherein a pair of posts extend from opposite ends of the body portion in opposite directions;

further comprising a fastening device attached to the housing for retaining the spacer and the circuit board to the housing;

wherein the fastening device has a body wall and a pair of latch arms extending from the body wall;

wherein each latch arm forms a latch projection, and wherein the housing defines a recessed cavity latching with the latch projection.

* * * * *